United States Patent [19]

Hergt et al.

[11] Patent Number: 4,752,187

[45] Date of Patent: Jun. 21, 1988

[54] RADIAL IMPELLER FOR FLUID FLOW MACHINES

[75] Inventors: Peter Hergt, Ludwigshafen; Alexander Nicklas, Dirmstein, both of Fed. Rep. of Germany

[73] Assignee: Klein, Schanzlin & Becker Aktiengesellschaft, Frankenthal, Fed. Rep. of Germany

[21] Appl. No.: 445,419

[22] Filed: Nov. 30, 1982

[30] Foreign Application Priority Data

Dec. 1, 1981 [DE] Fed. Rep. of Germany ..... 3147513

[51] Int. Cl.[4] ..... F04D 29/28

[52] U.S. Cl. ..... 416/186 R; 416/223 B

[58] Field of Search ..... 416/186 R, 223 B

[56] References Cited

U.S. PATENT DOCUMENTS

| | | | |
|---|---|---|---|
| 867,069 | 9/1907 | Neumann | 416/186 R |
| 3,788,765 | 1/1974 | Rusak | 416/186 R |
| 3,884,595 | 5/1975 | Herrick | 416/186 R |
| 4,389,160 | 6/1983 | Onal | 416/186 R |

FOREIGN PATENT DOCUMENTS

| | | | |
|---|---|---|---|
| 367318 | 6/1906 | France | 416/223 B |
| 512098 | 8/1939 | United Kingdom | 416/223 B |

*Primary Examiner*—Renee S. Luebke

*Attorney, Agent, or Firm*—Peter K. Kontler

[57] ABSTRACT

A radial impeller for use in centrifugal pumps wherein a reduction of the outer diameter entails a change in the total head but does not affect the capacity because the front coverplate of the impeller is inclined with reference to a plane that is normal to the impeller axis. The inclination of the outer marginal portion of the front coverplate with reference to such plane increases in response to decreasing outer diameter of the impeller. The specific speed of the impeller can be increased from approximately 11 to approximately 35 $min^{-1}$ by reducing the outer diameters of the coverplates. The exit angles of the vanes are selected in such a way that they remain constant irrespective of the selected outer diameters of the coverplates within the range which is required to change the specific speed from 11 to 35.

9 Claims, 1 Drawing Sheet

RADIAL IMPELLER FOR FLUID FLOW MACHINES

BACKGROUND OF THE INVENTION

The present invention relates to fluid flow machines in general, especially to improvements in centrifugal pumps. More specifically, the invention relates to improvements in radial impellers.

It is well known that specific speed is a frequently utilized characteristic of the optimal impeller shape required to achieve optimum efficiency of a fluid flow machine. For a radial impeller, the specific speed (nq) is normally between 11 and 35 $min^{-1}$. It is also known that the specific speed of a radial impeller can be varied by changing the outer diameters of its coverplates. Such changes of nq will be needed when the designer wishes to change the efficiency of the machine wherein the impeller is installed.

AT-PS No. 1 22 689 discloses that the operation of centrifugal pumps can be caused to conform to varying conditions by hollowing out the vanes of the impeller or by changing the outer diameter of the impeller. A drawback of such proposal is that each of these steps invariably entails a change in total head (H) as well as a change in the capacity (Q) of the machine.

OBJECTS AND SUMMARY OF THE INVENTION

An object of the invention is to provide a radial impeller which can be used in centrifugal pumps and which is constructed and assembled in such a way that it allows for changes in total head of the machine without changing the capacity and/or efficiency.

Another object of the invention is to provide an impeller wherein the coverplates are positioned in a novel and improved way so as to allow for changes in the specific speed of the impeller without altering the capacity of the machine which employs the impeller.

A further object of the invention is to provide a fluid flow machine embodying an impeller of the above outlined character.

An additional object of the invention is to provide a novel method of changing the total head of a fluid flow machine which employs one or more open or closed radial impellers while the capacity of the machine remains at least substantially unchanged.

The invention is embodied in a rotary radial impeller for use in fluid flow machines, expecially centrifugal pumps. The impeller comprises a back coverplate, a front coverplate and vane means between the two coverplates. At least one of the coverplates is inclined with reference to a plane which is normal to the axis of rotation of the impeller, and the specific speed (nq) of the impeller is arranged to increase up to a maximum value of approximately 35 $min^{-1}$ in response to a reduction of the outer diameter of the coverplates within a range of between a maximum diameter corresponding to the minimum specific speed (e.g., 11 $min^{-1}$) and a minimum diameter corresponding to a specific speed of approximately 35 $min^{-1}$. Furthermore, the vane exit angle is at least substantially constant for each diameter within the aforementioned range.

The inclination of the outer marginal portion of the one coverplate with reference to the aforementioned plane preferably increases in response to a reduction of the outer diameter of the one coverplate, i.e., the one coverplate can be suitably curved so as to ensure that the angle between the aforementioned plane and its outer peripheral or marginal portion increases as the outer diameter of the one coverplate decreases. For example, the inclination of the outer peripheral or marginal portion of the one coverplate with reference to the aforementioned plane can be between 3 and 5 degrees when the nq is between approximately 11 and 15 $min^{-1}$, the inclination can be between 4 and 7 degrees when the outer diameter of the one coverplate is reduced so that the nq is between approximately 15 and 22 $min^{-1}$, and the inclination can be between 5 and 8 degrees is the outer diameter of the one coverplate is reduced still further so as to increase the nq to between 22 and 35 $min^{-1}$.

The other coverplate may but need not be at least substantially parallel to the aforementioned plane, and the one coverplate can constitute the front coverplate of a closed impeller or a portion of the housing of the fluid flow machine if the impeller is an open impeller. The vane means defines at least one outlet passage whose width preferably increases in response to a reduction of the outer diameters of the coverplates.

The novel features which are considered as characteristic of the invention are set forth in particular in the appended claims. The improved impeller itself, however, both as to its construction and the mode of varying its specific speed, together with additional features and advantages thereof, will be best understood upon perusal of the following detailed description of certain specific embodiments with reference to the accompanying drawing.

DESCRIPTION OF THE PREFERRED EMBODIMENTS

Figure 1:
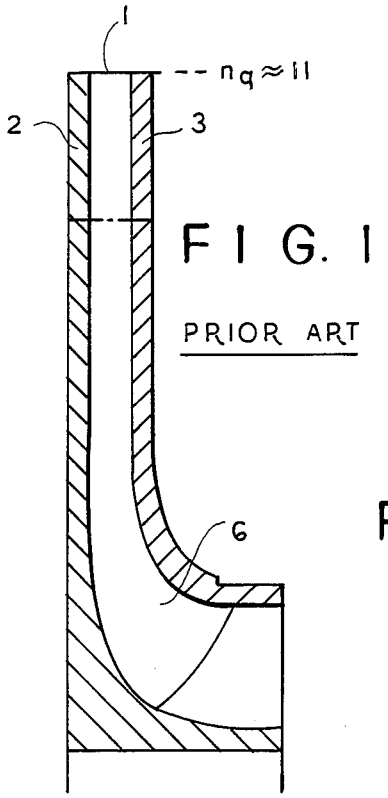
FIG. 1 PRIOR ART
FIG. 1 is a fragmentary schematic axial sectional view of a conventional radial impeller.

FIG. 1 shows a conventional radial impeller in a central sectional view. In view of its design, the impeller of FIG. 1 is assumed to have a specific speed (nq) of approximately 11 $min^{-1}$. The impeller includes a customary back coverplate or shroud 2, a customary front or outer coverplate 3, and vanes 6 between the two coverplates. In the region 1 of its outer diameter, the coverplates 2 and 3 are parallel to each other and to a plane which is normal to the axis of rotation of the impeller. When the outer diameter of such an impeller is reduced, the value of nq increases only negligibly.

Figure 2:
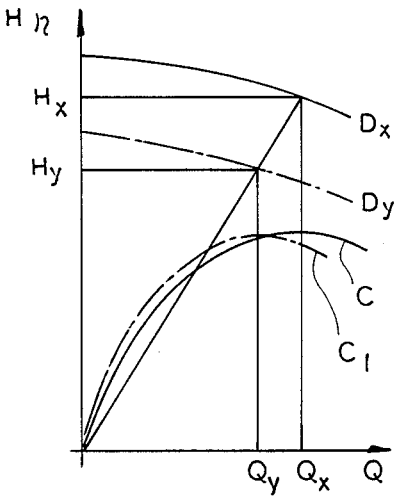
FIG. 2 is the capacity-total head diagram for the radial impeller of FIG. 1.

FIG. 2 shows the capacity (Q) to total head (H) diagram for the impeller of FIG. 1. The curve C which is indicated by solid lines is indicative of the Q/H ratio for an impeller having the outer diameter Dx. The phantom-line curve $C_1$ is indicative of the ratio Q/H when the outer diameter of the impeller shown in FIG. 1 is reduced from Dx to Dy. It will be noted that such reduction of the outer diameter to Dy entails a change in total head as well as a change of capacity.

Figure 3:
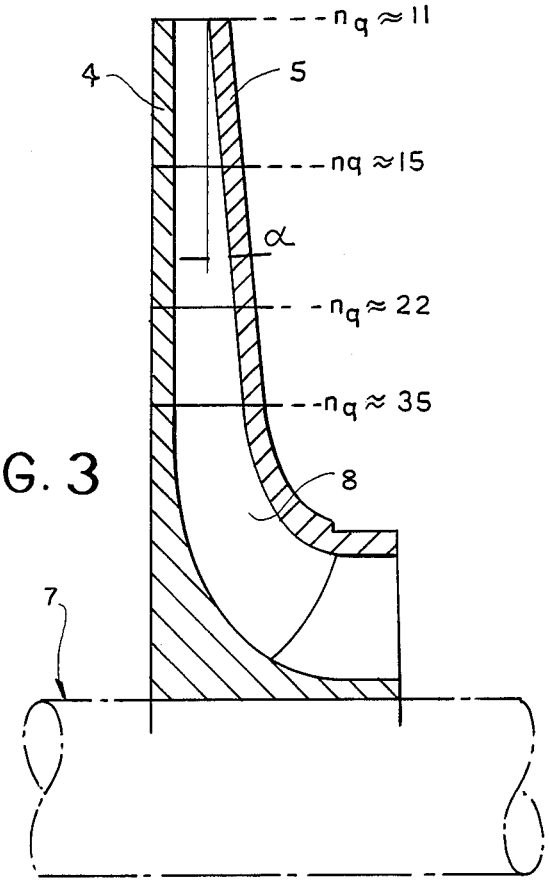
FIG. 3 is a fragmentary schematic axial sectional view of a radial impeller which embodies the present invention.

FIG. 3 shows a portion of a novel impeller wherein the back coverplate or shroud 4 is located in a plane making an angle of 90 degrees with the axis of the shaft 7 of the fluid flow machine, and wherein the front or outer coverplate 5 makes with such axis an oblique angle. The angle between the plane of the front coverplate 5 and a plane which is normal to the axis of the shaft 7 is shown at alpha. A vane of the improved impeller is shown at 8. The magnitude of the angle alpha increases in a direction from the outer diameter of the impeller toward the shaft 7. The configuration of vanes 8 is selected in such a way that the vane outlet or exit angle remains unchanged while the specific speed nq changes from 11 to 35 $min^{-1}$. It will be noted that the value of nq increases in response to a reduction of the outer diameter of the impeller.

Figure 4:
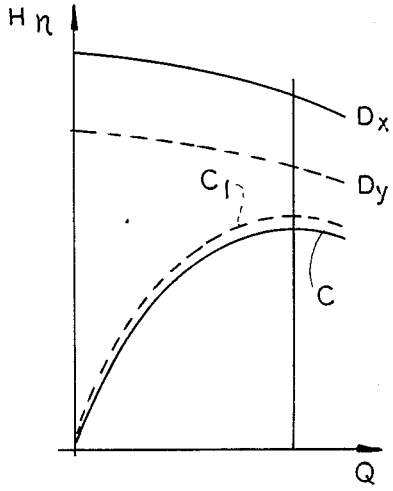
FIG. 4 is the capacity-total head diagram for the radial impeller of FIG. 3.

FIG. 4 shows that, when the value of nq is changed by reducing the outer diameter of the impeller shown in FIG. 3, the capacity Q remains at least substantially unchanged.

In accordance with a presently preferred embodiment of the invention, the angle alpha is between 3 and 5 degrees when the value of nq is increased from 11 $min^{-1}$ (maximum outer diameter) to 15 $min^{-1}$, the angle alpha is between 4 and 7 degrees when the value of nq is increased from 15 to 22 $min^{-1}$, and the angle alpha is between 5 and 8 degrees when the value of nq is increased from 22 to 35 $min^{-1}$ as a result of a corresponding reduction of the outer diameter of the improved impeller.

Similar results can be achieved if the front coverplate 5 is normal to the axis of the shaft 7 and the angle alpha is defined by the back coverplate 4 and a plane which is normal to the axis of the shaft 7. Furthermore, the improved impeller may be a closed impeller wherein the parts 4, 5 and 8 form a unitary structure or an open impeller wherein the front or outer coverplate 5 is part of the housing of the fluid flow machine.

In accordance with the present invention, it is now possible to change the total head H of the fluid flow machine while the capacity Q and/or efficiency remains at least substantially unchanged. Such advantages are achieved by departing from heretofore known and accepted proposals according to which the planes of both coverplates should be at least substantially normal to the axis of the shaft on which the impeller is mounted. Thus, it is now proposed to install at least one of the coverplates in such a way that it makes an acute angle with the plane which is normal to the axis of the shaft, and also to select the configuration of the vanes in such a way that their exit angle does not change as a result of changes of nq, i.e., as a result of changes in the outer diameter of the improved impeller. The outer diameter can be reduced by milling or by resorting to another available technique. If the exit angle of the vanes is constant and the outer diameter of the impeller is reduced in order to increase the value of nq in a manner as discussed in connection with FIGS. 3 and 4, the width of the vane channel increases with decreasing diameter of the impeller. This ensures that the capacity remains at least substantially constant and the efficiency of the impeller increases as a result of an increase in the value of nq.

An increase of the angle alpha in a direction from the periphery toward the axis of the impeller ensures that the value of nq can be raised to 35 $min^{-1}$ by reducing the outer diameter of the impeller in a manner as indicated in FIG. 3. It will be appreciated that one can employ a closed impeller wherein only one of the coverplates exhibits a curvature which is necessary to ensure that the angle alpha increases in a direction radially toward the axis of the impeller or wherein each of the two coverplates is appropriately curved, or an open impeller wherein the single coverplate is flat and the adjacent portion of the housing exhibits the requisite curvature and/or vice versa.

An important advantage of the improved radial impeller is that it is now possible to uniformize and simplify the design of radial impellers. Furthermore, one can resort to a uniform design of vanes which is acceptable within the entire range of nq, namely, from approximately 11 to approximately 35 $min^{-1}$. Furthermore, and in view of the fact that the width of the outlet of the impeller increases with a reduction of the outer diameter of the impeller, it is now possible to resort to wider guide wheels resp. helices so as to further improve the efficiency of the fluid flow machine which employ the improved impeller.

As concerns the exact meaning of the specific speed nq, reference may be had to pages 250 and 251 of the second (1980) edition of Centrifugal Pump Lexicon which is published by the assignee of the present application. The passage on pages 250–251 further provides formulae for conversion of nq into the so-called type number K which is a term frequently used in American and English centrifugal pump literature. As pointed out in said passage, nq equals $n_N(Q_{opt}^{\frac{1}{2}}/H_{opt}^{\frac{3}{4}})$ wherein $n_N$ is nominal rotational speed in $min^{-1}$, $Q_{opt}$ is optimum capacity in $m^3/s$, and $H_{opt}$ is optimum total head in m.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A rotary radial impeller for use in fluid flow machines, comprising a back coverplate, a front coverplate and arcuate vanes between said coverplates, at least one of said coverplates being inclined with reference to a plane which is normal to the axis of rotation of the impeller and the specific speed (nq) of the impeller being arranged to increase up to approximately 35 $min^{-1}$ in response to a reduction of the outer diameters of said coverplates within a range of between a maximum diameter corresponding to minimum specific speed and a minimum diameter corresponding to a specific speed of approximately 35 $min^{-1}$, the vane exit angle being at least substantially constant for each diameter within said range.

2. The impeller of claim 1, wherein the inclination of the outer marginal portion of said one coverplate with reference to said plane increases in response to a reduction of the outer diameter of said one coverplate.

3. The impeller of claim 2, wherein said inclination is between 3 and 5 degrees in the nq-range of between approximately 11 and 15 $min^{-1}$, between 4 and 7 degrees in the rang of between approximately 15 and 22 $min^{-1}$, and between 5 and 8 degrees in the range of between approximately 22 and 35 $min^{-1}$.

4. The impeller of claim 1, wherein the other of said coverplates is at least substantially parallel to said plane.

5. The impeller of claim 1, wherein said one coverplate is said front coverplate.

6. The impeller of claim 1, wherein the machine includes a housing and said front coverplate forms part of said housing.

7. The impeller of claim 1 wherein said back coverplate is normal to said axis and said one coverplate is said front coverplate.

8. The impeller of claim 1, wherein the minimal specific speed is approximately 11 $min^{-1}$.

9. The impeller of claim 1, wherein said vane means defines at least one outlet passage and the width of said passage increase is response to a reduction of the outer diameters of said coverplates.

* * * * *